United States Patent [19]

Bell, Jr.

[11] 4,150,759

[45] Apr. 24, 1979

[54] SOLIDS FEEDER APPARATUS

[75] Inventor: Harold S. Bell, Jr., Madison, N.J.

[73] Assignee: The United States of America as represented by the United States Department of Energy, Washington, D.C.

[21] Appl. No.: 856,365

[22] Filed: Dec. 1, 1977

[51] Int. Cl.[2] ..... C10J 3/30

[52] U.S. Cl. ..... 214/187; 222/137; 414/217; 48/86 R

[58] Field of Search ..... 214/17 B, 17 C, 18 R, 214/23, 35; 48/86 R; 222/129, 135, 137

[56] References Cited

U.S. PATENT DOCUMENTS 1,875,921 9/1932 Grant et al. ..... 214/17 B

*Primary Examiner*—Robert G. Sheridan

*Attorney, Agent, or Firm*—Dean E. Carlson; Leonard Belkin

[57] ABSTRACT

This invention sets forth a double-acting piston, which carries a floating piston, and which is reciprocated in a housing, for feeding coal to a high pressure gasifier system. The housing has a plurality of solids (for instance: coal) in-feeding ports and a single discharge port, the latter port being in communication with a high pressure gasifier system. The double-acting piston sequentially and individually communicates each of the in-feeding ports with the discharge port. The floating piston both seals off the discharge port while each in-feeding port is receiving coal or the like, to prevent undue escape of gas from the gasifier system, and translates in the housing, following a discharge of coal or the like into the discharge port, to return gas which has been admitted into the housing back into the gasifier system.

8 Claims, 6 Drawing Figures

OPERATING SEQUENCE
PISTON FEEDER, DOUBLE ACTING

SOLIDS FEEDER APPARATUS

BACKGROUND OF THE INVENTION

In coal gasification technology and practice, it is required to load coal into a high pressure reactor or gasifier, and the lock hoppers and slurry feed systems used heretofore for such purpose have many problems associated therewith. Notable among these problems is the inherent escape and loss of gas from the gasifier as a consequence of loading coal thereinto. What has been needed then is an alternate system or apparatus which, besides ancillary features, prevents the loss of gas while feeding, which uses high pressure process gas, and means which does not require a carrier fluid for the coal or like solids.

SUMMARY OF INVENTION

This invention provides apparatus for feeding coal into a high pressure gasifier, comprising housing means having a single discharge port and a plurality of laterally disposed inlet ports, shaft assembly means having two first pistons that are spaced at a fixed distance apart, and second piston means alternately floatable between the fixed pistons to admit coal to the housing and deliver it to the discharge port.

DESCRIPTION OF THE PREFERRED EMBODIMENT

Figure 1:
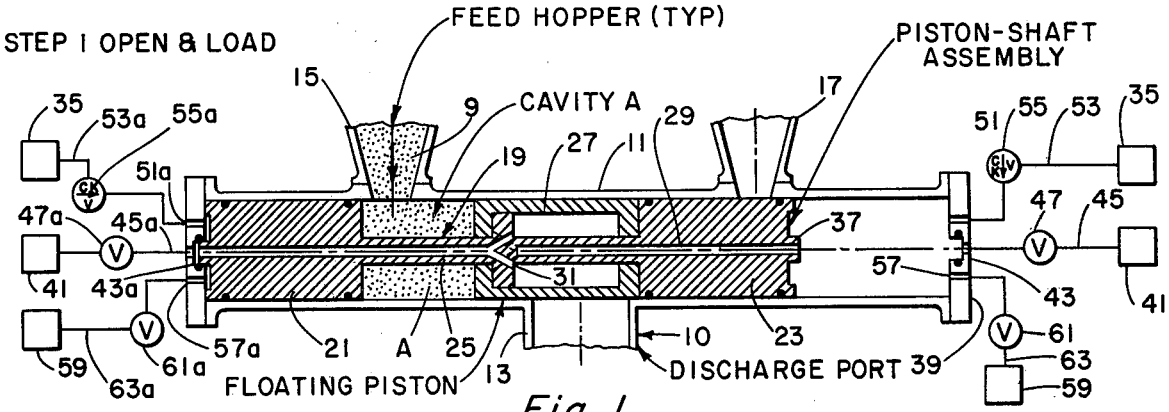
FIG. 1 is a partial cross-section of one embodiment of this invention in the loading mode.
Figure 2:
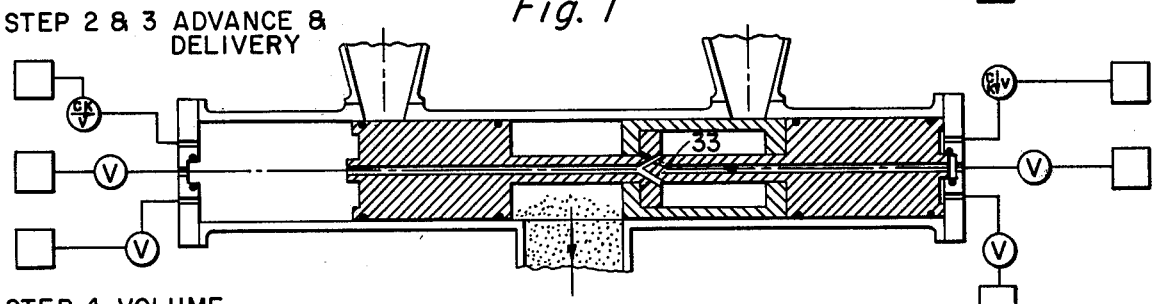
FIG. 2 shows the apparatus of FIG. 1 in a first delivery mode.
Figure 3:
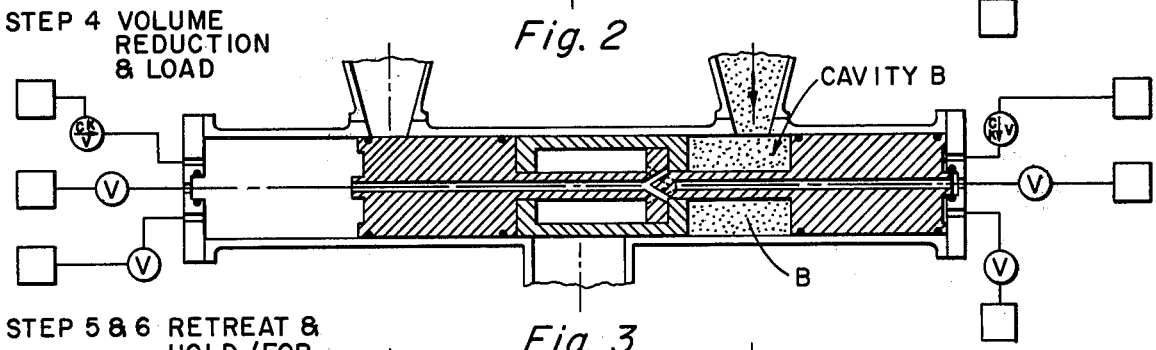
FIG. 3 shows the loading and simultaneous gas return mode of operation of the embodiment.

Referring to FIG. 1, the main elements of this invention for loading coal 9 into a gasifier line 10, comprise a housing means 11 having a single discharge port 13 and two laterally disposed inlet ports 15 and 17. A shaft assembly 19 rides back and forth in the housing means. This assembly has two first pistons 21 and 23 at a fixed distance apart. Carried on the connecting shaft 25 between the two first pistons is a floating second piston 27. The shaft 25 has a center passage 29 and first and second orifice means or feed ports 31 and 33. Connected to the housing means 11 are a first low-pressure fluid-actuating means 35, a second high-pressure fluid-actuating means 41, and a sump 59.

The two first pistons 21 and 23 have probes 37 that alternately close upon and engage housing end plates 39 to provide a connection between the passages 29 and a high-pressure fluid-actuating or actuation means 41. Actuation means 41 is connected to the end plate ports 43 and 43*a* through lines 45 and 45*a* and two-way valves 47 and 47*a*.

The first fluid-actuating or actuation means 35 is provided for biasing or translating the first pistons 21 and 23 back and forth. It comprises a low-pressure source of fluid that is selectively connected (by control means not shown) to an inlet port 51 through a line 53 and a check valve 55. The outlet port 57 connects with a sump 59 through valve 61 and line 63. These components are shown in association with the right-hand (as viewed in the Figure) side or end of the apparatus. As can be seen, however, corresponding ports and lines are associated with the opposite end of the apparatus; the same carry like or same index numbers, as those just detailed, to denote like or same functions.

In operation, the coal 9 is charged into the housing 11 through feed port 15, as shown in FIG. 1, to fill a cavity "A". To actuate to the right, so as to feed the cavity-A coal into the discharge port 13, low-pressure fluid is introduced through corresponding (left-hand side) port 51*a* from low pressure actuation means 35 by way of line 53*a* and check valve 55*a*. This delivers the coal (to the gasifier) via port 13 and line 10.

In the next step, the floating piston 27 is moved (to the left) to cause the high pressure gas to return to the gasifier and to permit the introduction of coal through the second feed port 17. With the translation of piston 27 (to the left) into cavity-A, a cavity "B" is defined. This action is accomplished by introducing high pressure fluid from the actuation means 41 through line 45 and valve 47. This simultaneously loads coal cavity-B.

Shaft 25 carries a limit-stop means or abutment 70 which is enclosed by a compartment 72 formed within piston 27. Abutment 70 alternately engages end walls of the compartment 72, upon the piston 27 being caused to translate along shaft 25, to delimit the travel of the piston 27. Now then, as high pressure fluid is admitted into port 43, probe 37 and passage 29, it vents through orifice means or feed ports 33. These ports open externally of the shaft 25 onto the left-hand side of the abutment. The high-pressure fluid operates on the interfaced surfaces of the piston compartment 72 and abutment 70 to cause them to separate and move the piston to the left—into a closure of port 13, while returning gas back into line 10.

Figure 4:
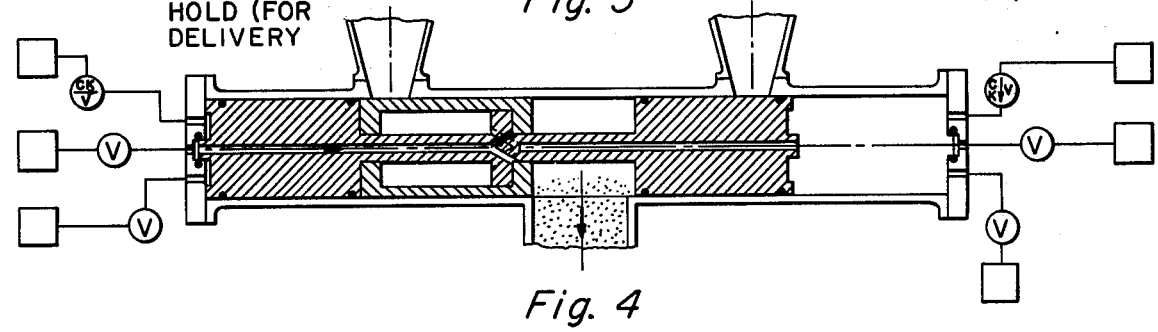
FIG. 4 shows the second delivery mode of operation.
Figure 5A:
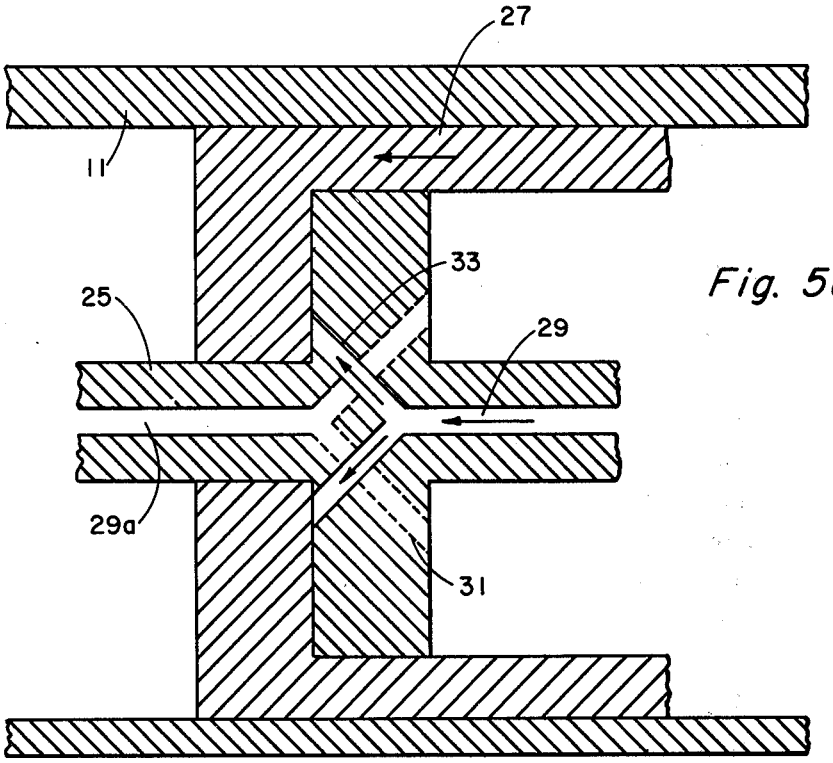
FIG. 5*a* is a detailed view of the floating piston shown in FIGS. 1 and 2.
Figure 5B:
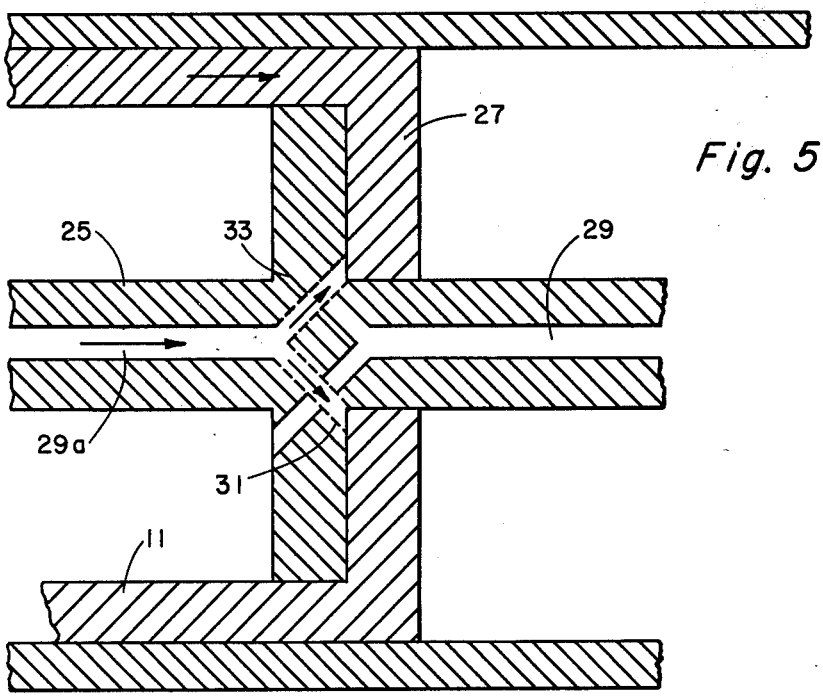
FIG. 5*b* is a detailed view of the floating piston shown in FIGS. 3 and 4.

To deliver the coal from cavity-B to the discharge port 13 and line 10, all pistons are biased in unison to the left, to the positioning as shown in FIG. 4. This is accomplished by pressurizing port 51 through actuation means 35 by way of line 53 and check valve 55. To vent the fluid trapped behind piston 21, valve 61*a* is opened to dump the trapped fluid to the sump. This valve 61*a* is opened simultaneously with the initiation of low pressure actuation means 35.

The floating piston is moved from the position shown in FIG. 4 to the position shown in FIG. 1 for introducing coal into cavity-A again in the beginning of a new cycle by introducing high pressure fluid from means 41 through probe 29*a*, port 43*a*, and ports 31 via line 45*a*. To this end, valve 47*a* is opened. Ports 31 open externally of the shaft 25 onto the right-hand side of the abutment 70—to separate the interfaced surfaces of the right-hand side of the abutment and the inner, right-hand wall of the compartment 72.

This displaces the floating piston from the position shown in FIG. 4 to the position shown in FIG. 1. This simultaneously displaces the high pressure gas from cavity-B into the gasifier.

This invention also has the advantage that it provides single malfunction safety protection in case of failure of any single actuation system component. To this end, the coal feed bin is always sealed off from the gasifier.

This invention has the additional advantage that it can feed all types of coal and any size required.

A still further advantage is that the coal is not physically or chemically altered, e.g., crushed, compacted, agglomerated or devolatilized.

While I have described my invention in connection with a specific embodiment thereof, it is to be clearly understood that this is done only by way of example, and not as a limitation to the scope of my invention as set forth in the objects thereof and in the appended claims.

What is claimed is:

1. Apparatus for feeding coal into a high pressure gasifier, comprising:

a. a high pressure gasifier containing a high pressure gas and having a longitudinally extending housing means forming a cylindrical inside surface, spaced apart inlet ports, and an outlet port disposed between the inlet ports for filling the gasifier with coal;

b. shaft assembly means forming oppositely directed axial passages having two first pistons in slidably sealing contact with the inside surface of the housing means and a shaft that separates the two first pistons at a fixed distance apart to form a longitudinally extending carrier defining a longitudinally extending, cylindrical, coal accepting cavity therebetween that is in communication with the opposite ends of the housing means through the respective passages;

c. means having an actuation fluid and first valves for selectively oppositely introducing and removing the fluid from the opposite ends of the housing means to bias the two first pistons back and forth in the housing means for alternately sequentially opening and closing the cavity from communication with the respective inlet ports for loading the gasifier with coal by alternately sequentially receiving and transporting the coal from the respective inlet ports to the outlet port; and d. second floating piston means in the housing means in slidably sealing contact with the inside surface thereof having means for pressurizing a portion of the cavity through the passages in accordance with the position of the two first pistons for alternately selectively biasing the floating piston means back and forth in slidably sealing contact with the inside of the housing means on opposite sides of the cavity in accordance with the direction of the pressurization of the cavity through the passages for alternately selectively closing the cavity from communication with one inlet port while one of the two first pistons closes the other inlet port from communication with the cavity, and for closing the cavity from communication with the outlet port when the cavity communicates with one of the inlet ports, so that the cavity is closed from communication with both of the inlet ports when the cavity communicates with the outlet port to load coal into the gasifier, and the gasifier is closed from communication with the inlet ports through the cavity when the cavity is closed from communication with the two inlet ports by one of the first two pistons and the second piston means respectively so as to prevent the escape of high pressure gas from the gasifier during the loading of the coal into cavity and from the cavity into the gasifier.

2. The apparatus of claim 1 in which the two pistons move in one direction to dump coal into the discharge port while backfilling with high pressure gas from the gasifier.

3. The apparatus of claim 2 in which the floating piston simultaneously opens the housing for loading while returning the high pressure gas to the gasifier.

4. The apparatus of claim 1 in which the floating piston and two first pistons have means for actuating their ends to move them back and forth in the housing simultaneously.

5. Apparatus for feeding solids, such as coal, into a pressurized receiver, comprising:

a. first means defining a solids-accepting chamber;

b. second means, communicating with said chamber for discharging solids from said chamber for conducting the solids therefrom to a pressurized receiver;

c. third means for loading solids from a plurality of spaced-apart locations into said chamber;

said third means comprising a plurality of spaced-apart solids feeding ports that open both externally of said chamber and internally thereinto, and transfer means for sequentially and individually communicating each of said ports with the discharging second means to cause a transfer of solids from said ports via said chamber to the discharging second means;

said transfer means comprising a piston assembly;

said piston assembly and chamber being engaged for relative slidable movement therebetween;

said piston assembly comprising a plurality of spaced-apart pistons commonly joined to a carrier;

said carrier, a surface of said chamber, and end surfaces of adjacent pistons of the plurality thereof comprising means cooperative to define at least one solids accepting cavity within said chamber;

said transfer means further comprising means in communication with said chamber and said piston assembly and operative to effect relative slidable movement between said piston assembly and said chamber to cause said one cavity to be in registry with one of said ports in a first operative mode of said apparatus, and in registry with said discharging means in a second operative mode of said apparatus;

said spaced-apart pistons being integrally joined to said carrier to maintain the spaced-apart disposition of said pistons;

said piston assembly further comprising a floating piston means joined to said carrier and slidably movable relative to said carrier for movement into and out of said one cavity; and said transfer means further including means in communication with said floating piston means and operative in a third operative mode of said apparatus to cause said floating piston means to move into said cavity at least while said cavity is in registry with said discharging means to close off communication between said cavity and said discharging means.

6. Apparatus, according to claim 5, wherein:

said floating piston means has a walled compartment formed therewithin;

said carrier comprises a shaft;

said shaft has limit-stop means formed thereon having a given surface disposed for contacting engagement with walls of said compartment to delimit slidable movement of said floating piston means relative to said shaft; and said transfer means includes conduit means formed in said shaft, given orifice means opening externally of said shaft in immediate adjacency to said given surface of said limit-stop means for communicating said conduit means with said compartment, and means for admitting pressured fluid into said conduit means.

7. Apparatus, according to claim 6, wherein:

said limit-stop means further has another surface also for contacting engagement with walls of said compartment to delimit movement of said floating piston means; and said transfer means further includes another orifice means opening externally of said shaft in immediate adjacency to said another surface of said limit-stop means, also for communicating said conduit means with said compartment.

8. Apparatus, according to claim 7, wherein:

said conduit means comprises a first conduit in communication with said given orifice means, and a second conduit in communication with said another orifice means.

* * * * *